United States Patent [19]

Nakahara et al.

[11] Patent Number: 4,797,344

[45] Date of Patent: Jan. 10, 1989

[54] ENCAPSULATED TONER HAVING SHELL WITH FIRST VINYL POLYMER WITH MN OF 2000-225000 AND SECOND VINYL POLYMER WITH MN OF 1000-15000

[75] Inventors: Toshiaki Nakahara, Tokyo; Ichiro Ohsaki, Kawasaki; Hisayuki Ushiyama, Hiratsuka; Masashi Kiuchi; Masuo Yamazaki, both of Kawasaki; Yasuhide Goseki; Hisayuki Ochi, both of Tokyo, all of Japan

[73] Assignee: Canon Kabushiki Kaisha, Tokyo, Japan

[21] Appl. No.: 911,099

[22] Filed: Sep. 24, 1986

[30] Foreign Application Priority Data

Sep. 30, 1985 [JP] Japan ..... 60-214988

[51] Int. Cl.[4] ..... G03G 9/16

[52] U.S. Cl. ..... 430/138; 428/402.21

[58] Field of Search ..... 430/106, 107, 108, 109, 430/111, 138; 428/402.21, 402.24

[56] References Cited

U.S. PATENT DOCUMENTS

| | | | |
|---|---|---|---|
| 4,259,426 | 3/1981 | Hasegawa | 430/98 |
| 4,497,885 | 2/1985 | Ushiyama | 430/106.6 |
| 4,517,273 | 5/1985 | Inoue | 430/111 |
| 4,533,617 | 8/1985 | Inoue et al. | 430/138 |
| 4,565,764 | 1/1986 | Nakahara et al. | 430/138 |
| 4,581,312 | 4/1986 | Nakahara et al. | 430/138 |
| 4,599,289 | 7/1986 | Suematsu | 430/98 |
| 4,661,430 | 4/1987 | Wakamiya | 430/120 |

*Primary Examiner*—John L. Goodrow

*Attorney, Agent, or Firm*—Fitzpatrick, Cella, Harper & Scinto

[57] ABSTRACT

An encapsulated toner is provided by coating core particles with an outer shell. The outer shell comprises, as predominant components thereof, vinyl polymers A and B of different molecular weights. More specifically, the ratio of the number-average molecular weight of the vinyl polymer A ($Mn_A$) to that of the vinyl polymer B ($Mn_B$) is in the range of 2 to 15. The vinyl polymers A and B respectively have a ratio of weight-average molecular weight to number-average molecular weight of 5 or less. Because of these specific molecular weight characteristics of the shell-constituting polymers, the durability and triboelectric charging characteristics of the encapsulated toner are improved. These effects are enhanced particularly when inorganic fine particles are attached to embedded in the surface or surface layer of the core particles.

20 Claims, No Drawings

ENCAPSULATED TONER HAVING SHELL WITH FIRST VINYL POLYMER WITH MN OF 2000-225000 AND SECOND VINYL POLYMER WITH MN OF 1000-15000

FIELD OF THE INVENTION AND RELATED ART

This invention relates to a toner to be used for electrophotography, electrostatic printing, etc., and particularly to an encapsulated toner adapted for pressure fixing.

Heretofore, as electrophotographic processes, a large number of processes have been known, including those disclosed in U.S. Pat. Nos. 2,297,691; 3,666,363; and 4,071,361. These processes generally use photoconductive materials and comprise the steps of forming an electrostatic latent image, subsequently developing the latent image with a toner, optionally transferring the resultant toner image onto a transfer material such as paper and fixing the toner image by means of heat, pressure, solvent vapor, etc., thereby to obtain a copy.

In order to fix a toner image, the heat-fixing system is generally adopted wherein the toner is heated and melted by an infrared radiation heater or a heating roller to be fusion-stuck onto a supporting medium. For the reasons such as prevention of the danger of fire and saving of power, the pressure-fixing system using rigid rollers is gradually being adopted in place of the heat-fixing system. Particularly, this pressure fixing system is advantageous in many respects such that no fear of scorching of copied sheets is involved, that copying operation can be started immediately after turning on the power supply and without requiring any waiting time, that high speed fixing is possible, and that the fixing apparatus is simple.

For such a pressure-fixable toner, particularly, the constituent resin is required to have characteristics suitable for pressure fixing, and the resins suited for this purpose are actively being developed. However, no practical pressure-fixable toner has yet been obtained, which is excellent in pressure-fixability, without causing offset to the pressure rollers, stable in developing and fixing performances during repeated use, without causing sticking onto carriers, metal sleeve or the surface of a photosensitive member, and also stable in storage stability without agglomeration or caking during storage. Particularly, with respect to pressure fixability, a problem remains in fixability onto plain paper.

In order to satisfy various properties required for the toner for pressure fixing, by using toners having a plurality of layers, several encapsulated toners have been proposed, wherein a shell of a hard resin is provided. Among such proposals, for example, there are an encapsulated toner comprising a core of a soft material as disclosed by U.S. Pat. No. 3,788,994 and an encapsulatd toner comprising a core of a soft resin solution. However, these encapsulated toners still have many unsolved problems such as insufficient pressure-fixability and off-set phenomenon and has not been reduced to commercial practice.

Further, in the encapsulated toners as described above, the resin as the shell material has not been fully examined especially with respect to the molecular weight thereof, so that the shell material does not have a sufficient strength nor has a sufficient durability as required for developers. Accordingly, the shell materials are often separated to contaminate or adhere onto the surfaces of the development sleeve, the photosensitive member, the carrier particles, etc. On the contrary, if the shell is made so thick as to satisfy the strength, the fixability of the toner becomes remarkably degraded. According to our study, when a vinyl polymer of a low molecular weight is used as a major component of the shell material of a pressure-fixable encapsulated toner, there is a tendency that the resultant capsule film surface becomes smooth to provide an initially good image quality, whereas there is involved a serious problem in respect of durability as the strength of the shell material is small. On the other hand, when a high molecular weight vinyl polymer is used, an improved durability is obtained, whereas there is a tendency that many projections are formed, so that there are involved problems such as deterioration of image quality due to unstable chargeability of toner particles and sepration of projecting shell materials when a flowability-improving agent is added, and unevenness of a toner layer formed on a development sleeve. Further, when a vinyl polymer having a broad molecular weight distribution ranging from a low molecular weight to a high molecular weight is simply used, the encapsulation becomes difficult so that there arises a problem that free particles of the shell material containing no core material are liable to occur, or agglomeration or polynucleation of particles is liable to occur due to coalescence.

SUMMARY OF THE INVENTION

An object of the present invention is to provide a pressure-fixable encapsulated toner free from defects as mentioned above through improvement in the shell material.

Another object of the present invention is to provide a pressure-fixable encapsulated toner having an excellent durabilty so that a good image quality is retained and staining of or sticking to a development sleeve, a photosensitive member or carriers is not caused even in a large number of copying operations, and still showing a good fixability at a lower pressure than before.

A further object of the present invention is to provide a pressure-fixable encapsulated toner showing an excellent and stable charge controllability.

Still another object of the present invention is to provide a pressure-fixable encapsulated toner which shows a good pressure-fixability and developing characteristic is electrostatically transferable even when formed into a one-component type developer containing magnetic particles.

According to our study, for the purpose of accomplishing the above objects, is has been found very effective to use, as a main component for consituting the outer shell of an encapsulated toner, a mixture of vinyl polymers having a molecular weight ratio therebetween in a specific range and respectively having a narrow molecular weight distribution.

The pressure-fixable encapsulated toner according to the present invention is based on the above knowledge, and more specifically, comprises microcapsules each a core material comprising a pressure-fixable component and an outer shell coating the core material, the outer shell comprising a vinyl polymer A and a vinyl polymer B of different molecular weights, the ratio of the number-average molecular weight of the vinyl polymer A to that of the vinyl polymer B being in the range of 2 to 15, the vinyl polymers A and B respectively having a ratio of weight-average molecular weight/number-average molecular weight of 5 or less.

By using the mixture of the vinyl polymers A and B, the durability and the flowability of the encapsulated toner are improved to provide images free of fog. Especially when the encapsulated toner is prepared by attaching inorganic fine particles to the core particles, followed by encapsulation with the outer shell, the above effects are remarkably developed.

The above mentioned and other objects and features of the invention will be better understood upon consideration of the following detailed description concluding with specific examples of practice. In the following description, "%" and "parts" representing quantity ratios are by weight unless otherwise noted specifically.

DETAILED DESCRIPTION OF THE INVENTION

The core material of the encapsulated toner of the invention basically comprises fine particles of a resinous material as the pressure-fixable component, and a colorant and/or a magnetic material dispersed in the resinous material.

Examples of soft solid materials showing a preferable pressure-fixability as the resinous material constituting the core material may include waxes (beeswax, carnauba wax, paraffin wax, microcrystalline wax), higher fatty acids (stearic acid, palmitic acid, lauric acid), higher fatty acid metal salts (aluminum stearate, lead stearate, barium stearate, magnesium stearate, zinc stearate, zinc palmitate), higher fatty acid derivatives (methylhydroxy stearate, glycerol monohydroxystearate), polyolefins (low molecular weight polyethylne, low molecular weight polypropylene, polyethylene oxide, polyisobutylene, polytetrafluoroethylene), and reaction products of the above with amino group-containing monomers such as vinyl monomers having a tertially amino group di-substituted with alkyls having 1–3 carbon atoms; olefin copolymers (ethylene-acrylic acid copolymer, ethylene-acrylate copolymer, ethylene-methacrylic acid copolymer, ethylene-methacrylate copolymer, ethylene-vinyl chloride copolymer, ethylene-vinyl acetate copolymer, ionomer resin), styrene resins (low molecular weight polystyrene, styrene-butadiene copolymer (monomer weight ratio: 5–30:-95–70), styrene-acrylic compound copolymer), epoxy resins, polyester resins (with acid values of 10 or less), rubbers (isobutylene rubber, nitrile rubber, chlorinated rubber), polyvinyl pyrrolidone, polyamide, coumarone-indene resin, methyl vinyl ether-maleic anhydride copolymer, maleic acid-modified phenol resin, phenol-modified terpene resin, and silicone resin. These can be used individually or in combination.

It is preferred that the core material contains a reaction product of a wax and an amino group-containing monomer as a soft solid component in respects of affinity with the outer shell and charge-controllability. Further, it is preferred to use the reaction product and a wax in combination in view of a mutual solubility therebetween. The amino group-containing monomer may preferably be used in a proportion of 0.1 to 10 parts per 100 parts of the wax, and the resultant reaction product may preferably be contained in a proportion of 1–50% based on the total resinous material or soft solid material.

In the core material for the encapsulated toner of the present invention, a colorant is contained, and various dyes and pigments are included as the colorant. As such dyes and pigments, it is possible to use, for example, Carbon black, Nigrosine dyes, Lamp black, Sudan black SM, Fast yellow G, Benzidine yellow, Pigment yellow, Indofast orange, Irgadine red, Paranitroaniline red, Toluidine red, Carmine FB, Permanent bordeau FRR, Pigment orange R, Lithol red 2G, Lake red C, Rhodamine FB, Rhodamine B lake, Methyl violet B lake, Phthalocyanine blue, Pigment blue, Brilliant green B, Phthalocyanine green, Oil yellow GG, Zapon fast yellow CGG, Kayaset Y 963, Kayaset YG, Smiplast yellow GG, Zapon fast orange RR, Oil scarlet, Smiplast orange G, Orazol brown B, Zapon fast scarlet CG, Aizenspiron red BEH or Cil pink OP.

When the encapsulated toner is to be used as a one-component magnetic toner, magnetic powder may be mixed into the core material. As the magnetic powder, a material which can be magnetized when placed in a magnetic field can be employed, and there may be included powder of a ferromagnetic metal such as iron, cobalt, nickel, etc., or alloys or compounds such as magnetite, hematite, ferrite, etc. Such a magnetic powder may also be used as a colorant. The content of the magnetic powder may preferably be 30–150 parts, particularly 50–90 parts per 100 parts of the total resinous material in the core material.

The core material of the encapsulated toner according to the present invention may for example be prepared by melt-kneading the above ingredients, and granulating the kneaded product by means of a spray dryer, optionally followed by classification, into fine particles with a volume-average particle size of 5–20$\mu$.

The core particles of the encapsulated toner according to the present invention may be modified into such a form that inorganic fine particles are attached to the core particles by external addition and mixing of the inorganic fine particles.

The inorganic fine particles to be used for this purpose may include powder or particles of inorganic material such as alumina, titanium dioxide, barium titanate, magnesium titanate, calcium titanate, strontium titanate, zinc oxide, siliceous sand, clay, mica, wollastonite, diatomaceous earth, various inorganic oxide pigments, chromium oxide, cerium oxide, red iron oxide, antimony trioxide, magnesium oxide, zirconium oxide, barium sulfate, barium carbonate, calcium carbonate, fine silica powder, silicone carbide, silicon nitride, boron carbide, tungsten carbide, and titanium carbide. As the inorganic fine particles, non-magnetic materials are generally employed, but it is possible to use magnetic particles. Among these, silica fine particles are preferred in respect of particle sizes and in order to provide a shape-retaining property to the core particles. These inorganic fine powder should preferably have hydrophobic groups on the surface, preferably including those treated with a hydrophobicity-imparting agent such as a silane coupling agent, a titanium coupling agent, silicone oil or a silicone oil having amine in the side chain. As the inorganic fine particles, there may be used those having more minute sizes than the core particles, preferably those having a specific surface area according to the BET method by $N_2$ adsorption of 50 to 400 $m^2/g$. Particularly, those particles obtained by treating silica fine particles having a specific surface area of 50–400 $m^2/g$ with such a hydrophobicity-imparting agent are preferred in respect of moisture resistance. The amount of addition of the inorganic fine particles may preferably be in the range of 0.1 to 50%, particularly 1 to 10% based on the weight of the core particles. During the external addition and mixing, the inorganic fine particles are attached to the surface or embedded in the surface layer of the core particles.

By attaching or embedding the inorganic fine particles to or in the surface portion of the core particles, not only the mechanical strength of the core particles is increased, but also the bonding or engagement between the core particles and the outer shell is enhanced.

The encapsulated toner according to the present invention is composed of the core particles as described above and the outer shell coating the core particle surfaces. The surface of each core particle can be partially coated with the outer shell, but it is preferred that the entire surface of each core particle be covered with the outer shell.

The outer shell comprises, as predominant components thereof, vinyl polymers A and B of different number-average molecular weights, wherein the ratio of the number-average molecular weight of the vinyl polymer A to that of the vinyl polymer B is in the range of 2 to 15, and the vinyl polymers A and B respectively have a ratio of weight-average molecular weight/number-average molecular weight of 5 or less, preferably 3.5 or less.

When a capsule film forming an outer shell covering core particles is formed from a polymer, the capsule film surface is liable to form excessive unevenness. Particularly when a high molecular weight vinyl polymer is used as a main component of the shell material, the capsule film surface is liable to form excessive projections. In the present invention, the above described vinyl polymers A and B of different molecular weight characteristics having a molecular weight ratio in and a molecular weight distribution specific ranges, are used as predominant components (constituting 50% or more, preferably 60% or more) of the outer shell of an encapsulated toner, whereby the above mentioned unevenness problem of the outer shell can also be solved.

The vinyl polymer A and the vinyl polymer B mentioned above may be obtained as homopolymers of or copolymers of two or more species of the following vinyl monomers:

Styrene monomers including sytrene and is derivatives such as styrene, o-methylstyrene, m-methylstyrene, p-methylstyrene, p-methoxystyrene, p-pehnylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylenically unsaturated mono-olefins such as ethylene, propylene, butylene, and isobutylene; vinyl halides such as vinyl chloride, vinylidene chloride, vinyl bromide, and vinyl fluoride; vinyl esters such as vinyl acetate, vinyl propionate, and vinyl benzoate; α-methylenealiphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, and phenyl methacrylate; methyl α-chloromethacrylate, maleic acid, maleic acid esters, acrylates such as methyl acrylate, ethyl acrylate, n-butyl acrylate, iso-butyl acrylate, propyl acrylate, n-octyl acrylate, dodecyl acrylate, 2-ethylhexyl acrylate, stearyl acrylate, 2-chloroethyl acrylate and phenyl acrylate; vinyl ethers such as vinyl methyl ether, vinyl ethyl ether and vinyl isobutyl ether; vinyl ketones such as vinyl methyl ketone, vinyl hexyl ketone, and methyl isopropenyl ketone; N-vinyl compounds such as N-vinylpyrole, N-vinylcarbazole, N-vinylindole, and N-vinylpyrrolidone; vinylnaphthalenes; derivatives of acrylic acid and methacrylic acid such as acrylonitrile, methacrylonitrile, and acrylamide; tertiary amino group-containing vinyl monomers such as dimethylaminoethyl methacrylate, N,N-dimethylaminophenyl acrylate, 2-vinylpyridine, dimethylaminopropyl acryliamide, and diethylaminoethyl methacrylate.

Among these, copolymers of a styrene monomer and a tertiary amino group-containing vinyl monomer are especially preferred because they also have a charge controlling characteristic. Preferred molar copolymerization ratio between the styrene monomer and the tertiary amino group-containing vinyl monomer is within the range of 1:0.01 to 1:0.5.

According to the present invention, the vinyl polymers A and B are required to satisfy such molecular weight characteristics that the ratio $Mn_A/Mn_B$ is in the range of 2 to 15, preferably 3 to 10, and the ratios $Mw_A/Mn_A$ and $Mw_B/Mn_B$ are respectively 5 or less. Herein, $Mn_A$ and $Mn_B$ represent the number-average molecular weights of the vinyl polymers A and B, respectively, and $Mw_A$ and $Mw_B$ represent the weight-average molecular weights of the vinyl polymers A and B, respectively. The weight ratio of the vinyl polymer A to the vinyl polymer B may preferably be in the range of 1:4 to 10:1. Further, the ratio Mw/Mn of weight-average molecular weight to number-average molecular weight of the mixture of the vinyl polymers A and B should preferably be 3.5 or more, more preferably 3.5–8, most preferably 3.5–5.

More specifically, $Mn_A$ of the vinyl polymer A may be in the range of 2,000–225,000, preferably 4,000–100,000, more preferably 15,000–30,000. $Mn_B$ of the vinyl polymer B may be in the range of 1,000–15,000, preferably 3,000–12,000, more preferably 3,500–12,000. The molecular weights below the lower limits increase a tendency of resulting in a remarkable lowering in anti-blocking characteristic, while the molecular weights exceeding the upper limits provide a difficulty in forming a uniform shell on the surfaces of the core particles. According to the present invention, it becomes possible that even a high molecular-weight vinyl polymer can provide a smooth shell of a uniform thickness on core particles because of the co-presence of a lower molecular weight vinyl polymer. When $Mn_A/Mn_B$ is less than 2, the shell-forming polymer becomes close to a single molecular weight polymer so that the effect of the present invention will not be sufficiently exhibited. On the other hand, in a case where $Mn_A/Mn_B$ exceeds 15, or in a case where $Mw_A/Mn_A$ or $Mw_B/Mn_B$ exceeds 5, particles of the shell material not containing the core material or coalescence or agglomeration of particles is liable to occur during the encapsulation operation, so that the encapsulated particles are liable to from polynuclei particles and cause agglomeration. Thus, it is undesirable. Accordingly, it is required that the vinyl polymers A and B respectively have a sharp molecular weight distribution in terms of Mw/Mn being 5 or less, preferably 3.5 or less.

The vinyl polymers satisfying the above mentioned molecular weight conditions may be obtained by control of conditions for polymerization of vinyl monomers, fractionation of constituent polymers prepared in advance, or combination of these. The regulation of polymerization conditions can be effected by regulation of a concentration of monomer, polymerization initiator and/or chain transfer agent during the bulk polymerization, the solution polymerization, the suspension polymerization, the emulsion polymerization, etc., or by the living polymerization using an anionic initiator or the cationic polymerization. Further, fractionation of constituent polymers can be effected, typically, by fractional precipitation, fractional dissolution, column fractionation and gel permeation chromatography (GPC).

The values of Mn and Mw/Mn used for defining the present invention have been obtained by GPC under the following measurement conditions.

Thus, tetrahydrofuran was first caused to flow at a rate of 1 ml/min. through a GPC column (Shodex 80M commercially available from Showa Denko K.K., Japan) and then a 0.1% sample polymer solution in tetrahydrofuran was injected for measurement in a volume of 300 to 500 ml to the column. Before measurement of the molecular weight of a sample polymer, a calibration curve was prepared by using several monodisperse standard polystyrene samples and the conditions such as the sample concentration and the sensitivity of a detector were adjusted so that the resultant calibration curve (log. molecular weight vs. count (accumulated volume of eluate)) would assume a linearity. In the above measurement, the reliability was checked whether or not the measurement according to the above conditions of NBS 706 polystyrene standard sample (available from General Science, Corp.) gave an Mw/Mn value of 2.11±0.10. The measurement was conducted by a GPC instrument, Model 150 manufactured by Waters Associate, Inc.

In the present invention, the vinyl polymers A and B are used to constitute a major proportion of the shell material, whereas vinyl polymers showing a different molecular weight characteristic or other types of resin may be mixed in a proportion of less than 40%.

Examples of the polymers or resins which may be used for this purpose include polymers of the following monomers: styrene and substituted derivatives thereof such as styrene, p-chlorostyrene, and p-dimethylaminostyrene; esters of acrylic acid or methacrylic acid such as methyl acrylate, ethyl acrylate, butyl acrylate, methyl methacrylate, ethyl methacrylate, butyl methacrylate, and N,N-dimethylaminoethyl methacrylate; maleic anhydride or half-ester, half-amide or diesterimide of maleic anhydride; nitrogen-containing vinyl compounds such as vinyl pyridine, and N-vinylimidazole; vinyl acetal such as vinyl formal, and vinyl butyral; vinyl monomers such as vinyl chloride, acrylonitrile, and vinyl acetate; and vinylidene monomers such as vinylidene chloride, and vinylidene fluoride. It is also possible to use a homopolmer, a copolymer or a mixture thereof such as polyester, polycarbonate, polysulfonate, polyamide, polyurethane, polyurea, epoxy resin, rosin, modified rosin, terpene resin, phenol resin, aliphatic or alicyclic hydrocarbon resin, aromatic petroleum resin, melamine resin, polyether resin such as polyphenylene oxide, or thioether resin.

It is preferred that vinyl polymers A and B comprising styrene and a tertiary amino group-containing are contained in a proportion of 90% or more for such a purpose that the resultant resin for constituting the outer shell is provided with a positive charge controllability.

In order to obtain an encapsulated toner comprising an outer shell of these polymers, various known encapsulation techniques may be available. For example, the spray drying method, the drying-in-liquid method, and the phase separation method may suitably applied. Among these, it is preferred to use a process wherein a solution of a shell material dissolved in an organic solvent also containing solid core particles dispersed therein is subjected to phase separation to precipitate the shell material on the surfaces of the core particles, in order to fully exhibit the characteristics of the outer shell material according to the present invention.

The encapsulated toner according to the present invention thus obtained may be formed as microcapsules generally having an average particle size of 5–18μ with an outer shell having a thickness of 0.05–0.5μ.

As described hereinabove, according to the present invention, there is provided a pressure-fixable encapsulated toner which has excellent durability, pressure-fixability and developing characteristic in combination, by containing vinyl polymers of different molecular weights having a molecular weight ratio in a specific range and respectively having a narrow molecular weight distribution.

Hereinbelow, the present invention will be explained more specifically by way of Examples and Comparative Examples.

EXAMPLE 1

Core particles were prepared by melt-mixing 30 parts of a graft reaction product of 100 g of paraffin wax and 5 g of dimethylaminoethyl methacrylate, 20 parts of polyethylene wax, 20 parts of paraffin wax, 30 parts of carnauba wax, and 80 parts of magnetite with a particle size of 0.2μ at 120° C., followed by granulation by means of a spray drier and dry classification, whereby spherical solid core particles having a volume-average particle size of 11.3μ were obtained.

The core particles were encapsulated by the phase separation method from an organic phase in the following manner. Into 450 parts of a solution in dimethylformamide (DMF) of 9.2 parts of styrenedimethylaminoethyl methacrylate (mol ratio=90/10) copolymer having an $Mn_A$ of 24,130 and a ratio $Mw_A/Mn_A$ of 1.9 and 3.7 parts styrene-dimethylaminoethyl methacrylate (mol ratio=90/10) copolymer having an $Mn_B$ of 5,308 and a ratio $Mw_B/Mn_B$ of 2.3 cooled to below 0° C., 100 parts of the above core particles were dispersed. The ratio $Mn_A/Mn_B$ was 4.5, and the mixture of the vinyl polymers A and B showed an weight-average molecular weight (Mw) of 38,800, a number-average molecular weight (Mn) of 8,300, and a ratio Mw/Mn of 4.7. Into the dispersion under stirring, water was added dropwise, whereby coacervate droplets of styrenedimethylaminoethyl methacrylate copolymers were precipitated on the core particles with the addition of water, finally to obtain encapsulated particles having an about 0.35μ-thick shell.

When the encapsulated particles were observed through a scanning electron microscope, the outer shell surfaces were almost flat with little unevenness and no free shell material was observed to be present.

Then, to 100 g of the encapsulated particles, 0.8 g of hydrophobic colloidal silica was externally added and mixed by means of a coffee mill to obtain a developer.

1 g of the developer was mixed with 9 g of iron powder (200–300 mesh) for measurement of triboelectric charge according to a conventional method, whereby a value of +8.4 μC/g was obtained. The developer was applied to a developing apparatus provided with a magnetic sleeve to develop a negative electrostatic latent image, and the resultant toner image was transferred to a wood-free paper. The paper having the toner image was passed through a pressure fixing equipment having two pressure rollers capable of exerting a contact pressure from both sides, whereby a substantially complete fixing characteristic was observed at a speed of 115 mm/sec and a line pressure of 14 kg/cm. The resultant image density was 1.3, and a clear image free of fog was formed at a good performance.

Further, the developer was subjected to a durability test by 8 hours of blank rotation at a speed of 115 mm, and after that, again subjected to image formation, whereby an image density of 1.5 was obtained without change in image quality, thus showing an excellent durability. The triboelectric charge of the developer at that time was +9.3 μC/g, and no staining or sticking was observed on the sleeve surface. Further, the toner surfaces were observed through an electron microscope, whereby no peeling of the shell was observed.

COMPARATIVE EXAMPLE 1

Core particles prepared in the same manner as in Example 1 were encapsulated only with styrenedimethylaminoethyl methacrylate (mol ratio=90/10) copolymer having an Mn of 5,308 and an Mw/Mn value of 2.30 in a similar manner as in Example 1, followed by external addition of hydrophobic silica as in Example 1 to prepare a developer.

The outer shell surfaces of the toner were smooth and free of unevenness according to the observation through a scanning electron microscope, and the triboelectric charge was measured to be +9.8 μC/g. When the developer was subjected to a development and fixing test as in Example 1, images obtained at the initial stage showed a good image quality free of fog as in Example 1 and an image density of 1.2. However, the images obtained after 8 hours of blank rotation showed a lowered density of 0.6 and were accompanied with fog. The triboelectric charge of the developer increased to +17.5 μC/g, and thin streaks of sticking was observed on the development sleeve. When the surfaces of encapsulated particles in the developer were observed through an electron microscope, peeling of the shells was partially recognized.

EXAMPLES 2-7, COMARATIVE EXAMPLES 2-3

Toners were prepared and evaluated in the same manner as in Example 1 except that outer shell-constituting polymers were replaced by those listed in the following Table. The results are also shown in the following Table, wherein the respective symbols have the following meanings:

o: good,
oΔ: rather good,
Δ: rather bad, and
×: bad.

Further, in the following Table, the following abbreviations are used for indicating monomers for producing vinyl polymers:

DMAEM: dimethylaminoethyl methacrylate,
DMAPM: p-N,N-dimethylaminophenyl methacrylate,
2VP: 2-vinylpyridine,
MMA: methyl methacrylate, and
DPAEM: dipropylaminoethyl methacrylate.

TABLE

| | Shell-constituting polymer | | | Image quality at initial stage | After durability test | |
|---|---|---|---|---|---|---|
| | Polymer composition (polymer mixing weight ratio) | Molecular weight characteristic | Toner surface state | | Staining & sticking | Image quality |
| Comparative Example 2 | A: styrene/DMAEM (mol ratio = 90/10) copolymer | $Mn_A$ = 70515, $Mw_A/Mn_A$ = 4.9 | Shell partly forming projections, agglomeration of particles observed. | Scattering, fog. Rather bad (Δ) | None | oΔ |
| | B: styrene/DMAEM (mol ratio = 90/10) copolymer (A/B = 5/2) | $Mn_B$ = 5001, $Mw_B/Mn_B$ = 2.2 $Mn_A/Mn_B$ = 15.7 | | | | |
| Comparative Example 3 | A: styrene/DMAEM (mol ratio = 90/10) copolymer | $Mn_A$ = 33221, $Mw_A/Mn_A$ = 6.3 | Particles agglomerated to form polynuclei particles. | x | — | — |
| | B: styrene/DMAEM (mol ratio = 90/10) copolymer (A/B = 5/2) | $Mn_B$ = 5001, $Mw_B/Mn_B$ = 6.5 $Mn_A/Mn_B$ = 6.6 | Isolated shell resin particles observed. | | | |
| Example 2 | A: styrene/DMAEM (mol ratio = 90/10) copolymer | $Mn_A$ = 62763, $Mw_A/Mn_A$ = 2.7 | A part of particles had a shell with projections. | oΔ | None | o |
| | B: styrene/DMAEM (mol ratio = 90/10) copolymer (A/B = 5/2) | $Mn_B$ = 4501, $Mw_B/Mn_B$ = 2.2 $Mn_A/Mn_B$ = 13.9 | | | | |
| Example 3 | A: styrene/DMAEM (mol ratio = 90/10) copolymer | $Mn_A$ = 31532, $Mw_A/Mn_A$ = 4.7 | A part of particles had a shell with unevenness. | oΔ | None | o |
| | B: styrene/DMAEM (mol ratio = 90/10) copolymer (A/B = 5/2) | $Mn_B$ = 4886, $Mw_B/Mn_B$ = 4.2 $Mn_A/Mn_B$ = 6.4 | | | | |
| Example 4 | A: styrene/DMAEM (mol ratio = 90/10) copolymer | $Mn_A$ = 20336, $Mw_A/Mn_A$ = 2.1 | Good | o | None | o |
| | B: styrene/DMAEM (mol ratio = 90/10) copolymer (A/B = 2/1) | $Mn_B$ = 5460, $Mw_B/Mn_B$ = 2.3 $Mn_A/Mn_B$ = 3.8 | | | | |

TABLE -continued

| | Shell-constituting polymer | | | Image quality at initial stage | After durability test | |
|---|---|---|---|---|---|---|
| | Polymer composition (polymer mixing weight ratio) | Molecular weight characteristic | Toner surface state | | Staining & sticking | Image quality |
| Example 5 | A: styrene/DMAPM (mol ratio = 90/10) copolymer | $Mn_A$ = 16744, $Mw_A/Mn_A$ = 2.1 | Good | o | None | o |
| | B: styrene/2VP (mol/ratio = 90/10) copolymer (A/B = 5/2) | $Mn_B$ = 5308, $Mw_B/Mn_B$ = 2.4 $Mn_A/Mn_B$ = 3.1 | | | | |
| Example 6 | A: styrene/DMAEM (mol ratio = 90/10) copolymer | $Mn_A$ = 24130, $Mw_A/Mn_A$ = 1.9 | Good | oΔ | None | oΔ |
| | B: styrene/DMAEM (mol ratio = 90/10) copolymer | $Mn_B$ = 5460, $Mw_B/Mn_B$ = 2.3 $Mn_A/Mn_B$ = 4.5 | | | | |
| | C: styrene/MMA (mol ratio = 50/50) copolymer (A/B/C = 23/9/18) | $Mn_C$ = 7600, $Mw_C$ = 14400 | | | | |
| Example 7 | A: styrene/DPAEM (mol ratio = 90/10) copolymer | $Mn_A$ = 36750, $Mw_A/Mn_A$ = 3.4 | Good | o | None | o |
| | B: styrene/DMAEM (mol ratio = 90/10) copolymer (A/B = 5/2) | $Mn_B$ = 4520, $Mw_B/Mn_B$ = 2.6 For the mixture, Mw/Mn = 3.8 | | | | |

EXAMPLE 8

Core particles were prepared by melt-mixing 30 parts of a graft reaction product of 100 g of paraffin wax and 5 g of dimethylaminoethyl methacrylate, 20 parts of polyethylene wax and 30 parts of carnauba wax, and 5 parts of phthalocyanine blue, followed by granulation and classification as in Example 1, whereby spherical solid core particles having a volume-average particle size of 12.5μ were obtained. To 100 parts of the core particles, 2 parts of silica fine powder (specific surface area: about 130 $m^2/g$) treated with an amino-modified silicone oil having amine group in the side chain was externally added and mixed to be attached to or embedded in the surface or surface layer of the core particles. Then, the external mixture of the core particles and the treated silica fine powder was coated with a mixture of styrene-dimethylaminopropylacrylamide (mol ratio=90/10) copolymer A (with $Mn_A$=23382, $Mw_A/Mn_A$=2.94) and styrene-diemthylaminoethyl methacrylate copolymer (mol ratio=90/10) copolymer B (with $Mn_B$=5308 (i.e., $Mn_A/Mn_B$=4.4), $Mw_B/Mn_B$=2.3) in a weight ratio of 5:2, in a coating thickness of 0.32μ.

When the encapsulated particles were observed through a scanning electron microscope, the outer shell surfaces were almost flat free of projections and no free shell material was observed to the present.

To 100 g of the encapsulated particles, 1.0 g of the above mentioned silica treated with the aminomodified silicone oil was externally added and mixed.

Then, the encapsulated toner was mixed with ferrite carrier particles of 250–350 mesh in a weight ratio of 1/10 to prepare a developer. The developer was used to develop a negative electrostatic latent image, and the resultant toner imamge was transferred to a wood-free paper and fixed under the same fixing conditions as in Example 1, whereby a good fixing characteristic was exhibited and a clear image free of fog was formed at an image density of 1.3.

Then, 200 g of the encapsulated toner was supplied and the developer was subjected to a continuous copying test of 3000 sheets with an A4 size manuscript, whereby good images free of fog were obtained without change and with utterly no staining or melt-sticking on the development sleeve, the photosensitive member, or the carrier surfaces.

COMPARATIVE EXAMPLE 4

Core particles prepared in the same manner as in Example 1 were encapsulated only with styrenedimethylaminoethyl methacrylate (mol ratio=90/10) copolymer having values of Mn=24130 and Mw/Mn=1.92 in a similar manner as in Example 1 to prepare an encapsulated toner. As a result of observation through a scanning electron microscope, the outer surfaces of the encapsulated toner showed more noticeable unevenness and more projections as compared with the encapsulated toner of Example 1.

To the encapsulated toner was externally added hydrophobic colloidal silica in the same manner as in Example 1 to prepare a developer showing a triboelectric charge of +15 μC/g. The developer was subjected to the same test as in Example 1, whereby a fixed toner image with an image density of 1.3 was obtained but with a higher degree of fog than the fixed toner image obtained in Example 1.

EXAMPLE 9

Spherical solid core particles were prepared in the same manner as in Example 1, and to 100 parts of the core particles, 2 parts of silica fine particles (specific surface area: about 140 $m^2/g$) treated with an amino-modified silicone oil having amine group in the side chain was externally added and mixed to be attached to or embedded in the surface or surface layer of the core particles.

Then, the core particle mixture was coated with the phase separation from an organic phase in the same manner (i.e., by adding water to a DMF solution of a shell material) in a coating film thickness of 0.3μ to form an encapsulated toner.

The surface of the toner was substantially free of projections of outer shell, and no free shell material was observed.

To 100 parts of the encapsulated toner, 0.8 part of hydrophobic silica was externally added and mixed by means of a coffee mill to obtain a developer. The triboelectric charge of the developer was measured in the same manner as in Example to be +8.8 μC/g.

The developer was applied to development, transfer and fixing in the same manner as in Example 1, whereby a substantially complete fixing characteristic was observed at a speed of 120 mm/sec and a line pressure of 13 kg/cm$^2$. A clear image free of fog was obtained at an image density of 1.35. The developer was further subjected to a durability test by 24 hours of blank rotation at a speed of 120 mm/sec in the developer, and after that, again subjected to image formation, whereby an image density of 1.55 was obtained without change in image quality, thus showing an excellent durability. The triboelectric charge of the developer at that time was +9.5 μC/g, and no staining or melt sticking was observed on the sleeve surface. Further, the toner surfaces were observed through an electron microscope, whereby no peeling of the shell was observed.

COMPARATIVE EXAMPLE 5

The core particles to which the silica particles had been attached of Example 8 were encapsulated only with styrene-dimethylaminoethyl methacrylate (mol ratio=90/10) copolymer (with Mn=24130, Mw/Mn=1.92) in a similar manner as in Example 1 to prepare an encapsulated toner.

When the encapsulated toner was observed through a scanning electron microscope, the surface of the toner showed more noticeable unevenness and more projections as compared with the encapsulated toner of Example 8, and particles only of the shell material containing no core particle were also observed.

To the encapsulated toner was externally added hydrophobic colloidal silica in the same manner as in Example 8 to prepare a developer, which was then tested in the same manner as in Example 8, whereby the resultant fixed image was accompanied with noticeable fog compared with that of Example 8.

What is claimed is:

1. An encapsulaed toner for developing electrostatic images, comprising microcapsules comprising:

a core particle and an outer shell coating the core particle;

the outer shell comprising a mixture having predominant components of a vinyl polymer A comprising a copolymer of a styrene monomer and a tertiary amino group-containing vinyl monomer having a number-average molecular weight of 2,000–225,000 and a vinyl polymer B comprising a copolymer of a styrene monomer and a tertiary amino group-containing vinyl monomer having a number-average molecular weight of 1,000–15,000 of different number-average molecular weights; the ratio of the number-average molecular weight of the vinyl polymer A ($Mn_A$) to that of the vinyl polymer B ($Mn_B$) being in the range of 2 to 15; the vinyl polymers A and B respectively having a ratio of weight-average molecular weight to number-average molecular weight of 5 or less and the weight ratio of the vinyl polymer A to the vinyl polymer B being in the range of 1:4 to 10:1.

2. The encapsulated toner according to claim 1, wherein said copolymer has a copolymerization ratio of the styrene monomer to the tertiary amino groupcontaining monomer in the range of 1:0.01 to 1:0.5.

3. The encapsulated toner according to claim 1, wherein the ratio $Mn_A/Mn_B$ is in the range of 3 to 10.

4. The encapsulated toner according to claim 1, wherein said core particle comprises inorganic fine particles attached to or embedded in the surface or surface layer of the core particles.

5. The encapsulated toner according to claim 4, wherein said inorganic fine particles have a specific surface area of 50–400 m$^2$/g according to the BET method by $N_2$ adsorption.

6. The encapsulated toner according to claim 5, wherein said inorganic fine particles are silica fine particles.

7. The encapsulated toner according to claim 1, wherein said core particle comprises a soft solid material showing pressure-fixability, and a colorant or magnetic powder.

8. The encapsulated toner according to claim 7, wherein said core particle has a volume-average particle size of 5–20μ.

9. The encapsulated toner according to claim 7, wherein said soft solid material comprises a wax.

10. The encapsulated toner according to claim 7, wherein said soft solid material comprises a reaction product between an amino group-containing monomer and a wax.

11. The encapsulated toner according to claim 10, wherein said amino group-containing monomer is dimethylaminoethyl methacrylate, and said wax is paraffin wax.

12. The encapsulated toner according to claim 1, wherein said outer shell comprises the vinyl polymers A and B in a proportion of 60 wt. % or more.

13. The encapsulated toner according to claim 1, wherein said core particle comprises inorganic fine particles attached to or embedded in the surface or surface layer of the core particle, said outer shell comprises the vinyl polymers A and B in a proportion of 60 wt. % or more, and said outer shell has been formed by phase separation from an organic phase.

14. The encapsulated toner according to claim 13, wherein said core particle comprises a reaction product between paraffin wax and dimethylaminoethyl methacrylate, polyethylene wax, paraffin wax and carnauba wax.

15. The encapsulated toner according to claim 14, wherein said core particle has been coated with the outer shell comprising the vinyl polymers A and B respectively comprising a styrene-dimethylaminoethyl methacrylate copolymer.

16. The encapsulated toner according to claim 1, wherein the vinyl polymer A has a number-average molecular weight of 4,000–100,000.

17. The encapsulated toner according to claim 16, wherein the vinyl polymer A has a number-average molecular weight of 15,000–30,000.

18. The encapsulated toner according to claim 1, wherein the vinyl polymer B has a number-average molecular weight of 3,500–15,000.

19. The encapsulated toner according to claim 18, wherein the vinyl polymer B has a number-average molecular weight of 3,000–12,000.

20. A process for producing an encapsulated toner, comprising:

dissolving, in an organic solvent, a shell material comprising a mixture having predominant components of a vinyl polymer A comprising a copolymer of a styrene monomer and a tertiary amino group-containing vinyl monomer having a number-average molecular weight of 2,000–225,000 and a vinyl polymer B comprising a copolymer of a styrene monomer and a tertiary amino group-containing vinyl monomer having a number-average molecular weight of 1,000–15,000 of different number-average molecular weights; the ratio of the number-average molecular weight of the vinyl polymer A ($Mn_A$) to that of the vinyl polymer B ($Mn_B$) being in the range of 2 to 15; the vinyl polymers A and B respectively having a ratio of weight-average molecular weight to number-average molecular weight of 5 or less and the weight ratio of the vinyl polymer A to the vinyl polymer B being in the range of 1:4 to 10:1, dispersing solid core particles in the resulting organic solution, and subjecting the resulting dispersion to phase separation in order to obtain the encapsulated toner.

* * * * *

UNITED STATES PATENT AND TRADEMARK OFFICE

CERTIFICATE OF CORRECTION

PATENT NO. : 4,797,344

DATED : January 10, 1989

INVENTOR(S) : TOSHIAKI NAKAHARA, ET AL.

It is certified that error appears in the above-identified patent and that said Letters Patent is hereby corrected as shown below:

IN [57] ABSTRACT

Line 15, "to embedded" should read --to or embedded--.

COLUMN 5

Line 33, delete "in".
Line 34, after "distribution" add --in--.

COLUMN 13

Line 47, "encapsulaed toner" should read --encapsulated toner--.

COLUMN 14

Line 3, "groupcon-" should read --group-con--.

Signed and Sealed this

Seventeenth Day of October, 1989

*Attest:*

DONALD J. QUIGG

*Attesting Officer*

*Commissioner of Patents and Trademarks*